US010660386B1

(12) United States Patent
Diamond et al.

(10) Patent No.: US 10,660,386 B1
(45) Date of Patent: May 26, 2020

(54) WORK GLOVE WITH FOREARM PROTECTIVE SLEEVE

(71) Applicants: Richard Diamond, Margate, FL (US); Rose Diamond, Margate, FL (US)

(72) Inventors: Richard Diamond, Margate, FL (US); Rose Diamond, Margate, FL (US)

( * ) Notice: Subject to any disclaimer, the term of this patent is extended or adjusted under 35 U.S.C. 154(b) by 79 days.

(21) Appl. No.: 16/120,640

(22) Filed: Sep. 4, 2018

(51) Int. Cl.

| | |
|---|---|
| ***A41D 19/00*** | (2006.01) |
| ***A41D 13/08*** | (2006.01) |
| ***A41D 19/015*** | (2006.01) |
| ***A41D 31/24*** | (2019.01) |

(52) U.S. Cl.
CPC ..... *A41D 19/0044* (2013.01); *A41D 13/08* (2013.01); *A41D 19/01505* (2013.01); *A41D 19/01558* (2013.01); *A41D 19/01576* (2013.01); *A41D 31/24* (2019.02); *A41D 2300/22* (2013.01); *A41D 2600/20* (2013.01)

(58) Field of Classification Search
CPC .... A41D 31/24; A41D 13/08; A41D 19/0044; A41D 19/0048; A41D 19/015; A41D 19/01529; A41D 19/01505; A41D 19/01558; A41D 19/01576
USPC ..... 2/16, 161.8, 161.6, 159, 160
See application file for complete search history.

(56) References Cited

U.S. PATENT DOCUMENTS

| | | | | |
|---|---|---|---|---|
| 4,287,608 | A * | 9/1981 | Meyer | A41D 19/015 139/420 R |
| 5,452,378 | A | 9/1995 | Rosen | |
| 5,625,900 | A * | 5/1997 | Hayes | A41D 19/01529 2/161.8 |
| 5,734,992 | A | 4/1998 | Ross | |
| 6,427,249 | B1 * | 8/2002 | Mattesky | A41D 19/01505 2/161.6 |
| D479,384 | S | 9/2003 | Sims | |
| 6,684,409 | B2 | 2/2004 | Fujihana | |
| D710,548 | S | 8/2014 | Salzman | |
| 9,125,443 | B2 | 9/2015 | Ochi | |
| 2008/0010720 | A1 | 1/2008 | Weiser | |
| 2016/0007663 | A1 | 1/2016 | Price | |

* cited by examiner

*Primary Examiner* — Gloria M Hale
(74) *Attorney, Agent, or Firm* — Kyle A. Fletcher, Esq.

(57) ABSTRACT

The work glove with forearm protective sleeve is a protective garment. The work glove with forearm protective sleeve protects the hand and forearm of a person wearing the work glove with forearm protective sleeve. The work glove with forearm protective sleeve comprises a hand covering and an arm covering. The hand covering is a covering is configured to protect the hand of the person. The arm covering is configured to protect the forearm of the person.

15 Claims, 3 Drawing Sheets

WORK GLOVE WITH FOREARM PROTECTIVE SLEEVE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including wearing apparel, more specifically, a protective glove made of a patchwork of different materials. (A41D19/01576)

SUMMARY OF INVENTION

The work glove with forearm protective sleeve is a protective garment. The work glove with forearm protective sleeve protects the hand and forearm of a person wearing the work glove with forearm protective sleeve. The work glove with forearm protective sleeve comprises a hand covering and an arm covering. The hand covering is a covering is configured to protect the hand of the person. The arm covering is configured to protect the forearm of the person.

These together with additional objects, features and advantages of the work glove with forearm protective sleeve will be readily apparent to those of ordinary skill in the art upon reading the following detailed description of the presently preferred, but nonetheless illustrative, embodiments when taken in conjunction with the accompanying drawings.

In this respect, before explaining the current embodiments of the work glove with forearm protective sleeve in detail, it is to be understood that the work glove with forearm protective sleeve is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the work glove with forearm protective sleeve.

It is therefore important that the claims be regarded as including such equivalent construction insofar as they do not depart from the spirit and scope of the work glove with forearm protective sleeve. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
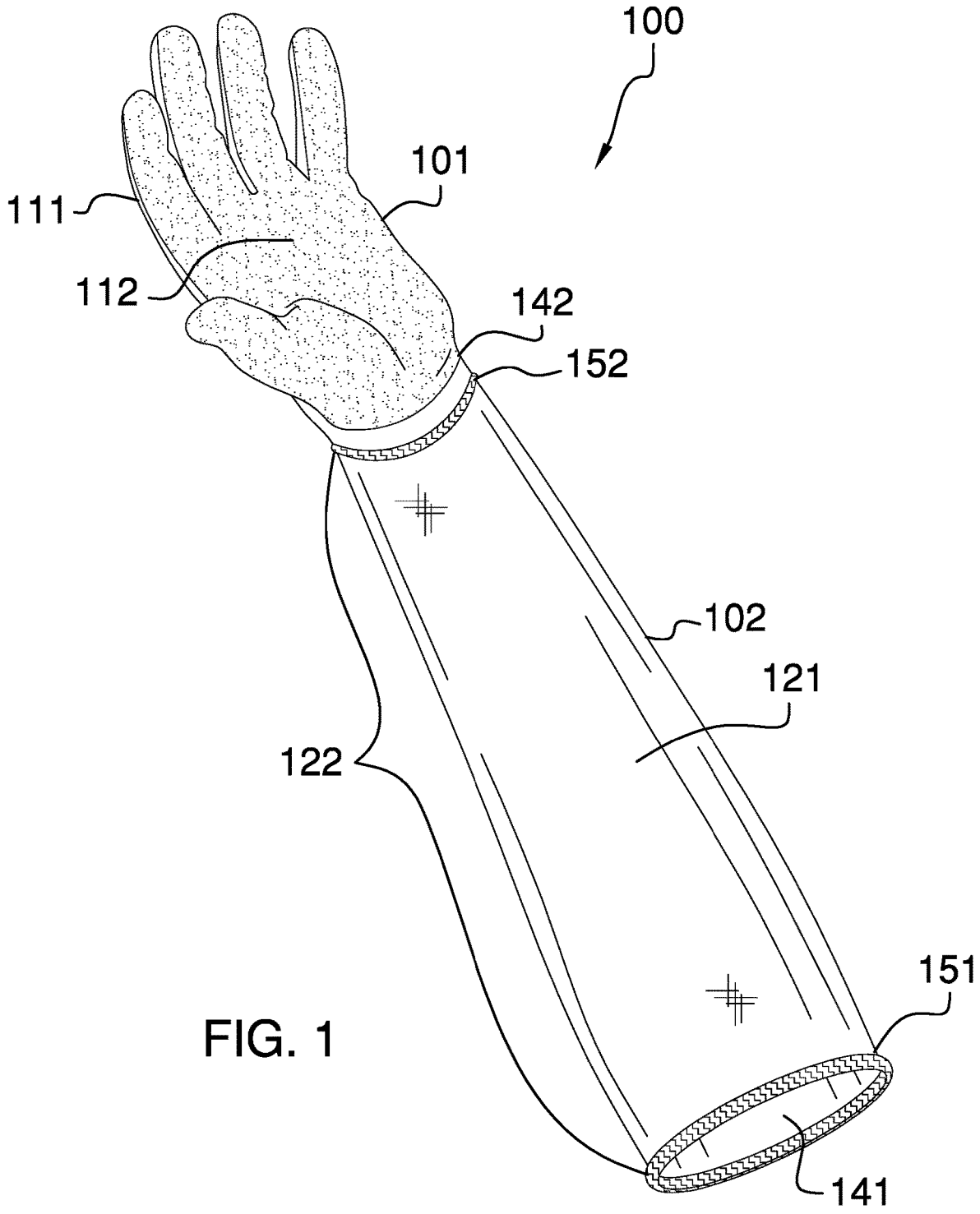
FIG. 1 is a perspective view of an embodiment of the disclosure.
Figure 2:
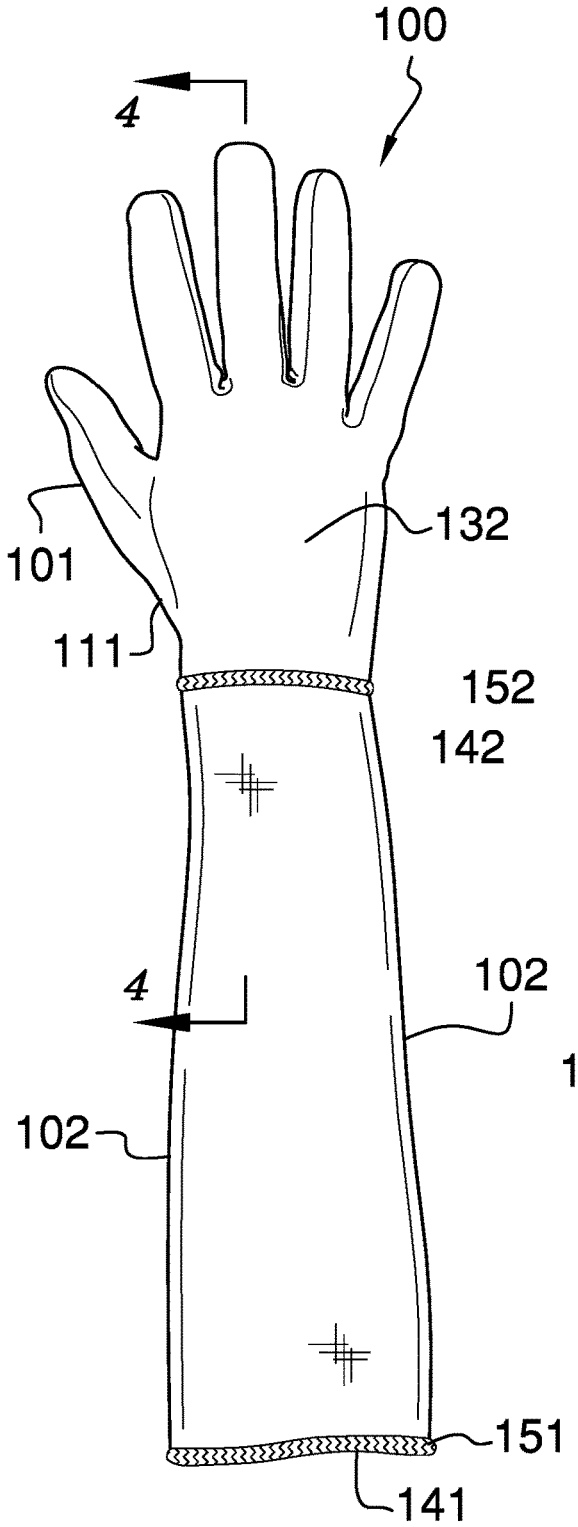
FIG. 2 is a front view of an embodiment of the disclosure.
Figure 3:
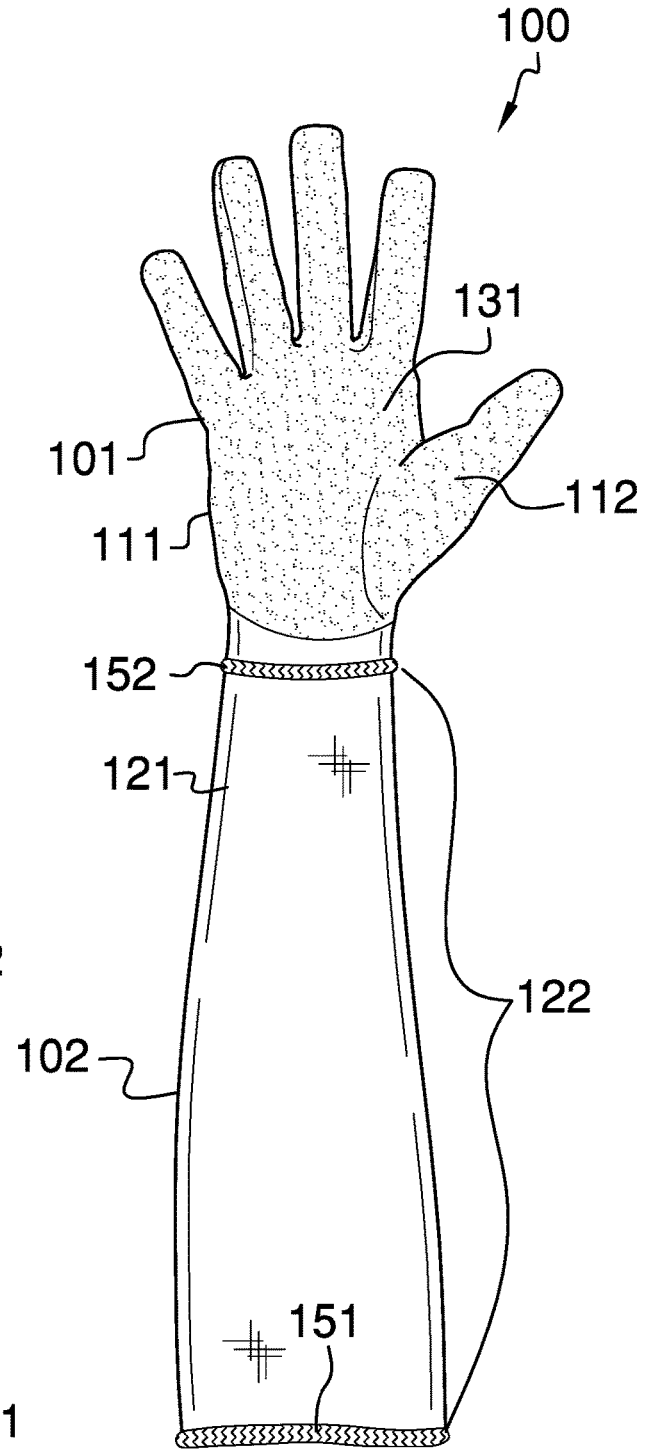
FIG. 3 is a rear view of an embodiment of the disclosure.
Figure 4:
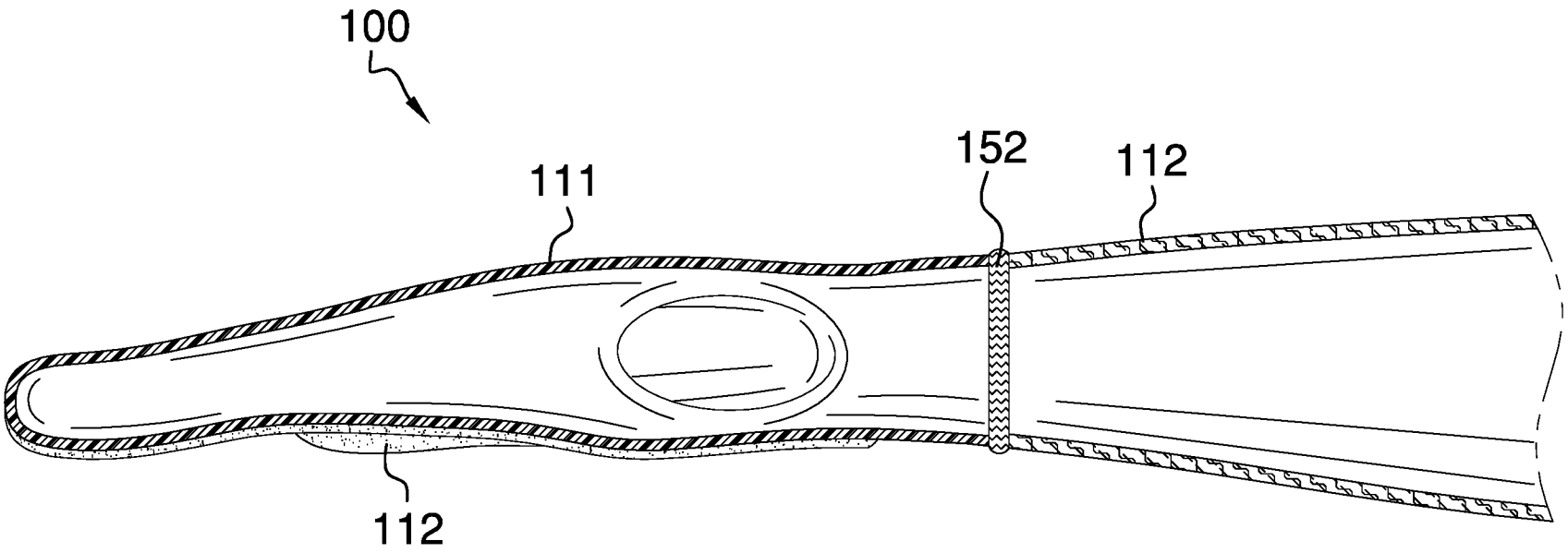
FIG. 4 is a cross-sectional view of an embodiment of the disclosure across 4-4 as shown in FIG. 2.

Detailed reference will now be made to one or more potential embodiments of the disclosure, which are illustrated in FIGS. 1 through 4.

The work glove with forearm protective sleeve 100 (hereinafter invention) is a protective garment. The invention 100 protects the hand and forearm of a person wearing the invention 100. The invention 100 comprises a hand covering 101 and an arm covering 102. The hand covering 101 is a covering that is configured to protect the hand of the person. The arm covering 102 is configured to protect the forearm of the person.

The hand covering 101 is a garment that is worn on the hand. The hand covering 101 comprises a glove 111 and a non-skid material 112. The glove 111 is further defined with a palm side 131 and a back side 132. The palm side 131 is defined in greater detail elsewhere in this disclosure. The back side 132 is defined in greater detail elsewhere in this disclosure.

The glove 111 is a well-known and documented apparel item. The design, manufacture, and use of a glove 111 is well-known and documented in the textile and apparel arts. The glove 111 is formed from a first canvas textile. The first canvas textile is an elastic textile such that the glove 111 binds to the hand when the glove 111 is deformed by the hand. The use of the first canvas textile for the glove 111 protects the hand from scratches.

The first canvas textile which forms the glove 111 acts as a spring. Specifically, when a hand inserts into the glove 111, a radial force is applied to the glove 111 in a direction away from the center of the glove 111. The applied radial force elongates the size of the glove 111 in the direction away from the center of the glove 111. The elasticity of the glove 111 creates a force that opposes the displacement created by the force applied by the hand. The elasticity of the glove 111 returns the glove 111 to its relaxed shape. The hand prevents the glove 111 from returning to its relaxed shape. In this circumstance, the glove 111 will apply a force projecting towards the center of the glove 111 that binds glove 111 to the hand.

The non-skid material 112 is a coating that is applied to the palm side 131 of the glove 111. The application of the non-skid material 112 to the palm side 131 of the glove 111 improves the contact security of the glove 111 when used for gripping. The non-skid material 112 is defined in greater detail elsewhere in this disclosure. The use of a non-skid material 112 for this purpose is well-known and documented in the textile and apparel arts.

The arm covering 102 is a tubular structure. The arm covering 102 covers the forearm associated with the hand that is covered by the hand covering 101. The arm covering 102 is a textile-based structure. The arm covering 102 comprises a sleeve 121 and a plurality of elastic bands 122. The sleeve 121 is further defined with a proximal end 141 and a distal end 142. The proximal end 141 is the end of the sleeve 121 that is distal from the glove 111. The hand enters the invention 100 through the proximal end 141 of the sleeve 121. The distal end 142 is the end of the sleeve 121 that attaches to the glove 111. The distal end 142 attaches the sleeve 121 to the glove 111 such that the hand will enter the glove 111 normally from the sleeve 121.

The sleeve 121 is a tubular structure. The sleeve 121 covers the forearm associated with the hand covered by the glove 111. The sleeve 121 is formed from a second canvas textile. The second canvas textile is an inelastic textile. The use of the second canvas textile for the sleeve 121 protects the forearm from scratches.

Each of the plurality of elastic bands 122 is an elastic loop structure. The plurality of elastic bands 122 secures the sleeve 121 to the forearm at the wrist and the elbow. Each of the plurality of elastic bands 122 is a commercially available webbing that is sewn into a loop.

The plurality of elastic bands 122 comprises a proximal elastic band 151 and a distal elastic band 152.

The proximal elastic band 151 is an elastic band that attaches to the proximal end 141 of the sleeve 121. The proximal elastic band 151 acts as a spring. Specifically, when the forearm inserts through the proximal elastic band 151, the pressing of the forearm against the proximal elastic band 151 applies a force that displaces the proximal elastic band 151 in a direction that is perpendicular to the center axis of the proximal elastic band 151. The elasticity of the proximal elastic band 151 creates a force that opposes the displacement created by the insertion of the forearm into the proximal elastic band 151. This opposing force is in a direction that returns the proximal elastic band 151 to its relaxed shape. Because the forearm prevents the proximal elastic band 151 from returning completely to its relaxed shape, the proximal elastic band 151 applies a force against the forearm that holds the proximal elastic band 151 in position.

The distal elastic band 152 is an elastic band that attaches to the distal end 142 of the sleeve 121 at the junction of the glove 111. The distal elastic band 152 acts as a spring. Specifically, when the forearm inserts through the distal elastic band 152, the pressing of the forearm against the distal elastic band 152 applies a force that displaces the distal elastic band 152 in a direction that is perpendicular to the center axis of the distal elastic band 152. The elasticity of the distal elastic band 152 creates a force that opposes the displacement created by the insertion of the forearm into the distal elastic band 152. This opposing force is in a direction that returns the distal elastic band 152 to its relaxed shape. Because the forearm prevents the distal elastic band 152 from returning completely to its relaxed shape, the distal elastic band 152 applies a force against the forearm that holds the distal elastic band 152 in position.

The following definitions were used in this disclosure:

Band: As used in this disclosure, a band is a flat loop of material.

Canvas: As used in this disclosure, canvas refers to a heavy-duty textile commonly used for mechanical and protective structures such as sails, awnings, and tents.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elastic Band: As used in this disclosure, an elastic band is a loop of textile that is formed using elastic material that can stretch. Alternatively, the elastic band can be a sheeting that is formed from latex, spandex, or an elastic plastic film that can stretch.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Yarn: As used in this disclosure, an elastic yarn is a yarn formed from elastomeric materials.

Glove: As used in this disclosure, a glove is an item of apparel that covers a hand. The glove comprises five finger stalls into which the fingers of the hand are inserted. A glove is further defined with a palm side and a back side. The palm side is proximal to the palm of the hand. The back side is distal from the palm side.

Loop: As used in this disclosure, a loop is the length of a first linear structure including, but not limited to, shafts, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Non-Skid Material: As used in this disclosure, a non-skid material is a material or structure that can be applied to an object such that the object is inhibited from sliding along the surface upon which the object is resting. Non-skid materials are often, but not always, adhesive, elastic, or abrasive materials.

Relaxed Shape: As used in this disclosure, a structure is considered to be in its relaxed state when no shear, strain, or torsional forces are being applied to the structure.

Sleeve: As used in this disclosure, a sleeve is a tube-like covering that is placed over a rod, shaft or other cylindrical object.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventors claim:

1. A protective garment comprising:
a hand covering and an arm covering;
wherein the arm covering attaches to the hand covering
wherein the hand covering is a garment that is configured to be worn on a hand;
wherein the arm covering is a garment that is configured to be worn on a forearm;
wherein the hand covering is configured to protect the hand of a person from scratches;
wherein the arm covering is configured to protect the forearm of the person from scratches;
wherein the first canvas textile is an elastic textile;
wherein the hand covering is a textile-based structure;
wherein the glove is formed from a first canvas textile;
wherein the sleeve is formed from a second canvas textile;
wherein the second canvas textile is an inelastic textile.

2. The protective garment according to claim 1 wherein the arm covering is a tubular structure.

3. The protective garment according to claim 2 wherein the arm covering is a textile-based structure.

4. The protective garment according to claim 3
wherein the hand covering comprises a glove and a non-skid material;
wherein the non-skid material attaches to the glove;
wherein the glove is further defined with a palm side and a back side.

5. The protective garment according to claim 4
wherein the first canvas textile which forms the glove acts as a spring;
wherein the glove applies a counter force that is configured to bind glove to the hand.

6. The protective garment according to claim 5 wherein the non-skid material is a coating that is applied to the palm side of the glove.

7. The protective garment according to claim 6
wherein the arm covering comprises a sleeve and a plurality of elastic bands;
wherein the plurality of elastic bands is configured to attach the sleeve to the forearm;
wherein the sleeve is further defined with a proximal end and a distal end.

8. The protective garment according to claim 7 wherein the distal end attaches the sleeve to the glove such that the hand is configured to enter the glove normally from the sleeve.

9. The protective garment according to claim 8 wherein the sleeve is a tubular structure.

10. The protective garment according to claim 9 wherein each of the plurality of elastic bands is an elastic loop structure.

11. The protective garment according to claim 10 wherein the plurality of elastic bands is configured to secure the sleeve to the forearm at the wrist and the elbow.

12. The protective garment according to claim 11
wherein each of the plurality of elastic bands is a webbing;
wherein each of the plurality of elastic bands is sewn into a loop.

13. The protective garment according to claim 12
wherein the plurality of elastic bands comprises a proximal elastic band and a distal elastic band;
wherein the proximal elastic band attaches to the proximal end of the sleeve;
wherein the distal elastic band attaches to the distal end of the sleeve.

14. The protective garment according to claim 13
wherein the proximal elastic band acts as a spring;
wherein the proximal elastic band applies a counter force that is configured to bind the to the forearm.

15. The protective garment according to claim 14
wherein the distal elastic band acts as a spring;
wherein the distal elastic band applies a counter force that is configured to bind the sleeve to the forearm.

* * * * *